US008389051B2

(12) United States Patent
Freudenberger et al.

(10) Patent No.: US 8,389,051 B2
(45) Date of Patent: Mar. 5, 2013

(54) ELECTRON ABSORBER LAYER

(75) Inventors: Joerg Freudenberger, Kalchreuth (DE); Oliver Stier, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 234 days.

(21) Appl. No.: 12/828,792

(22) Filed: Jul. 1, 2010

(65) Prior Publication Data

US 2011/0014484 A1 Jan. 20, 2011

(30) Foreign Application Priority Data

Jul. 17, 2009 (DE) ..... 10 2009 034 360

(51) Int. Cl.
*B05D 1/12* (2006.01)
*B05D 5/12* (2006.01)

(52) U.S. Cl. ..... 427/190; 427/77; 427/201

(58) Field of Classification Search ..... 427/77, 427/190, 201
See application file for complete search history.

(56) References Cited

U.S. PATENT DOCUMENTS

| | | | | |
|---|---|---|---|---|
| 5,302,414 | A | 4/1994 | Alkhimov et al. | |
| 2003/0219542 | A1 * | 11/2003 | Ewasyshyn et al. | 427/421 |
| 2008/0112538 | A1 * | 5/2008 | Rogers | 378/121 |

* cited by examiner

*Primary Examiner* — Frederick Parker
(74) *Attorney, Agent, or Firm* — Schiff Hardin LLP

(57) ABSTRACT

In a method for applying an electron absorber layer to a substrate, an electron absorber layer is produced from a composite material, by coating the substrate with a metallic material, and material inclusions made from an additional material are embedded in the metallic material during coating. The metallic material contains aluminum, magnesium, cobalt, iron, chromium, titanium, nickel, copper, or an alloy or mixture thereof. The additional material contains one or more of the following substances: boron, carbon or silicon, a mixture of these elements, one or more chemical compounds made from or having at least two of these elements, or a mixture of such chemical compounds.

17 Claims, 1 Drawing Sheet

ELECTRON ABSORBER LAYER

BACKGROUND OF THE INVENTION

1. Field of the Invention

The invention relates to an electron absorber layer and a method for applying an electron absorber layer to a substrate.

2. Description of the Prior Art

A method of the above type is disclosed in United States Published Patent Application No. 2008/0112538. In this method, the electron absorber layer is formed from a carbide, nitride or oxide, or alternatively from a metal. Metals cited in the publication are molybdenum, rhenium, zirconium, beryllium, nickel, titanium, niobium or copper.

SUMMARY OF THE INVENTION

An object of the invention is to provide a method with which a thermally loadable electron absorber layer having good absorber properties can be produced with particular ease.

This object is achieved according to the invention by an electron absorber layer is produced from a composite material by coating the substrate with a metallic material, and material inclusions made from an additional material are embedded in the metallic material during coating.

A substantial advantage of the inventive method is that the composite material enables the optimization both of the electron absorption properties of the electron absorber layer and, at the same time, of the thermal properties of the electron absorber layer separately from one another. Thus, for example, the metallic material of the electron absorber layer can be selected such that that electron absorber layer is adapted optimally to the substrate with regard to the coefficient of thermal expansion. If use is made, for example, of copper or steel as material for the substrate, the coefficient of thermal expansion of the electron absorber layer can be adapted to the coefficient of thermal expansion of the substrate, for example by selecting for the electron absorber layer a metallic material whose thermal expansion properties correspond to those of the substrate material as well as possible. The absorber properties of the electron absorber layer can be optimized separately with the use of the material inclusions or foreign inclusions embedded in the metallic material of the composite material. For example, material inclusions or incorporated materials are embedded in the metallic material that have an atomic number in the periodic table that is as low as possible. Specifically, a low atomic number enables the electron absorber layer to absorb electrons with particular efficiency. In summary, in the use of a composite material the inventive method enables the properties of the electron absorber layer that is to be produced to be adapted optimally to the substrate, and enables the best absorption properties to be achieved independently thereof.

In order to ensure a high electron absorption, it is regarded as advantageous when an additional material is selected or embedded that has on average, for example in terms of percent by weight, an atomic number which is as low as possible, preferably an atomic number of less than 14.

An atomic number that is low on average can be achieved when additional material is embedded that has one or more of the following substances, or includes up to at least 50% thereof: boron, carbon or silicon, or a mixture having at least two of these elements or one or more chemical compounds made from or having at least two of the three said elements or a mixture of such chemical compounds.

It is preferred to embed additional material that contains elemental boron, elemental carbon, in particular graphite, elemental silicon, or a mixture of those elements—preferably up to at least 50%.

Alternatively or in addition, it is also possible to embed additional material that contains boron carbide, silicon carbide or a mixture thereof—preferably up to at least 50%.

With regard to as large an electron absorption as possible, or with regard to an atomic number of the electron absorber layer which is as low as possible on average, it is regarded overall as advantageous when the fraction of the material inclusions in the composite material of the electron absorber layer is at least 50%.

The electron absorber layer is preferably applied to the substrate by cold gas spraying. Cold gas spraying permits very stable composite materials of very large layer thickness of a few 100 μm to be deposited cost effectively and even in the region of end contours. During cold gas spraying, the extreme reactability of, for example, boron, graphite or boron carbide does not cause trouble and neither is there a need to pay heed to solubility limits for the metallic material. Although cold gas spraying is regarded as particularly preferable, it is also alternatively possible to use other coating methods such as, for example, deposition methods from the gas phase (for example, CVD methods), sputtering methods or other methods.

It is preferred to select as metallic material a material that permits the incorporation of the material inclusions in particularly high concentrations. It is preferred to apply aluminum, magnesium, a mixture of aluminum and magnesium, or an aluminum-magnesium alloy to the substrate as metallic material, and the material inclusions are embedded in such a metallic material.

Alternatively, it is possible to make use as metallic material of cobalt, iron, chromium, an alloy made from two or all three of said metals, or a mixture of two or all three of said metals.

Again, titanium, nickel, copper, an alloy made from two or all three of said metals, or a mixture of two or all three of said metals come into consideration for the metallic material.

Of course, these metals, specifically aluminum, magnesium, cobalt, iron, chromium, titanium, nickel, copper can also be mixed or alloyed with one another in combinations other than those named, in order to form the metallic material for the composite material of the electron absorber layer.

It is preferred for the metallic material to be applied to the substrate in such a way that it forms a conductive metallic matrix on the substrate.

The invention further relates to an electron absorber layer. According to the invention, such an electron absorber layer is composed of a composite material in which material inclusions made from an additional material are embedded in a metallic material.

With reference to the advantages of the inventive electron absorber layer, reference may be made to the above statement in the context of the inventive method for applying an electron absorber layer, since the advantages of the electron absorber layer correspond substantially to those of the inventive method.

The metallic material preferably contains aluminum, magnesium, cobalt, iron, chromium, titanium, nickel, copper, an alloy made from at least two of said metals, or a mixture of at least two of said metals.

In a preferred embodiment, the fraction of the material inclusions in the composite material of the electron absorber layer is at least 50%, the metallic material contains aluminum, magnesium, cobalt, iron, chromium, an alloy made from at least two of said metals, or a mixture of at least two of said metals, and the additional material contains elementary boron, elementary carbon, in particular graphite, elementary silicon, or a mixture of said elements—preferably up to at least 50%.

DESCRIPTION OF THE PREFERRED EMBODIMENTS

Figure 1:
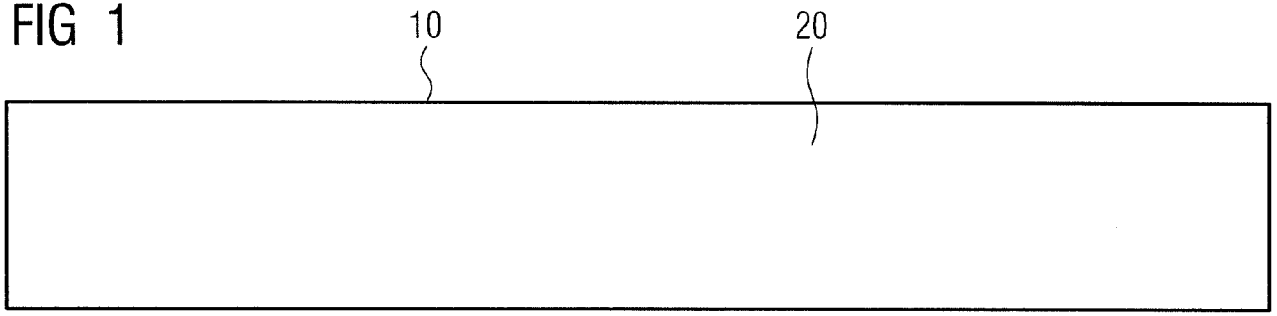
FIG. 1 shows an exemplary embodiment of a substrate without electron absorber layer.

A substrate 10 that consists of a substrate material 20 is to be seen in FIG. 1. The substrate material 20 can be, for example, copper or steel or another material.

Figure 2:
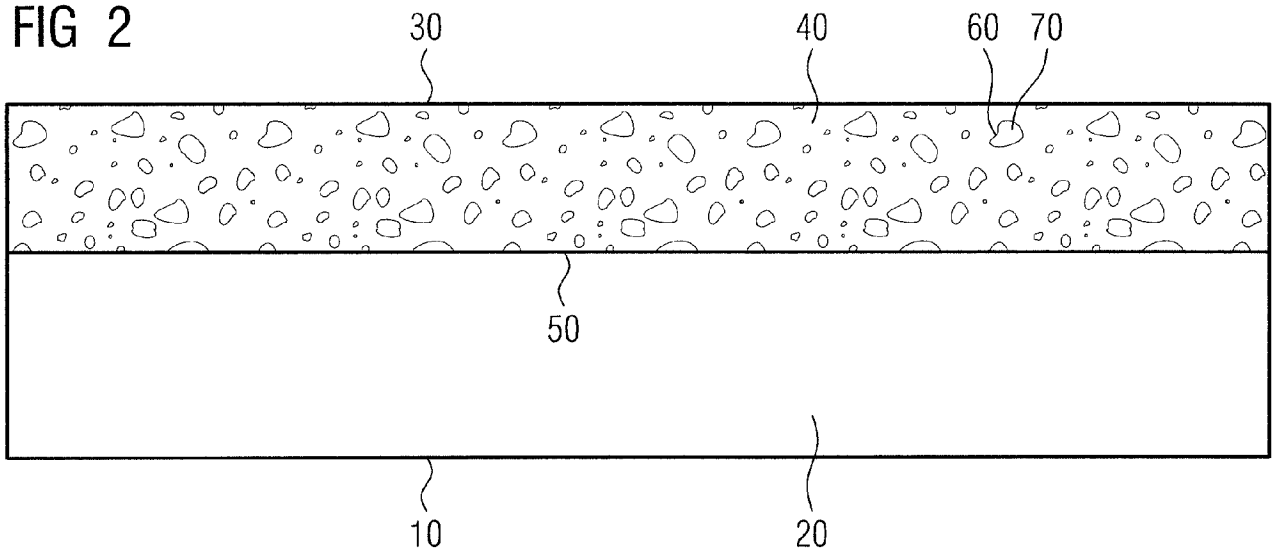
FIG. 2 shows the substrate in accordance with FIG. 1 after one application of an electron absorber layer.

FIG. 2 shows the substrate 10 after an electron absorber layer 30 has been applied, preferably by means of cold gas spraying. During cold gas spraying, a metallic material 40 is sprayed onto the surface 50 of the substrate 10 and, while the metallic material 40 is being sprayed on, material inclusions 60 made from an additional material 70 are also sprayed and are embedded in the metallic material 40.

The fraction of the material inclusions 60 is selected to be as large as possible and is preferably at least 50%.

The method described for applying the electron absorber layer 30 to the substrate 10 can be used, for example, in order to produce backscattered electron collectors, protective coatings of thermally heavily loaded regions and layers which minimize bremsstrahlung intensities in the case of x-ray tube exit windows.

It is preferred to select for the substrate 10 a substrate material 20 that self exhibits no particular electron absorption properties and is, for example, optimized with regard to other properties. For example, the substrate material 20 is selected with regard to a maximum mechanical strength or an optimum processability, for example weldability.

Those area portions of the surface 50 of the substrate 10 that are exposed to an electron radiation are coated with the electron absorber layer 30. In order in the case of the electron absorber layer 30 to achieve an electron absorption that is as high as possible, the material inclusions 60 preferably consist of an additional material 70 having an average atomic number as low as possible.

By way of example, the material inclusions 60 can be formed by brittle inclusions that need not necessarily be good conductors but, as already mentioned, should have an atomic number which is as small as possible. The fraction of the brittle phase or the brittle inclusions is preferably selected to be as large as possible. The maximum possible fraction of inclusions is limited, inter alia, by the deposition process in the application of the electron absorber layer 30 to the substrate 10; as already mentioned, a particularly large fraction of inclusions can be achieved by cold gas spraying.

Again, the fraction of inclusions that can be achieved is limited by other criteria, for example by the ability to be achieved by the electron absorber layer to withstand temperature changes, by the vacuum resistance to be achieved and/or by the electric conductivity and thermal conductivity of the electron absorber layer to be achieved.

The metallic material 40, which holds the material inclusions 60 together in a manner of an adhesive, preferably consists of a tactile phase of aluminum, magnesium, titanium, chromium, cobalt, nickel, copper, or alloys or mixtures of said metals.

The metal inclusions 60 that is to say the brittle phase within the electron absorber layer 30, preferably consist of boron, boron carbide, silicon carbide or graphite.

As noted above, the electron absorber layer 30 is preferably applied by means of cold gas spraying. Specifically, in a very advantageous way cold gas spraying permits very stable composite materials of very large layer thickness of a few 100 μm to be deposited cost effectively and even in the region of end contours. During cold gas spraying, the extreme reactability of, for example, boron, graphite or boron carbide does not cause trouble and neither is there a need to pay heed to solubility limits for the ductile matrix that preferably forms the metallic material 40. It is possible by mixing or producing alloys of said metals to adapt the coefficient of thermal expansion of the ductile phase or of the metallic material 40, and thus the coefficient of thermal expansion of the resulting electron absorber layer 30 in an optimum way to the coefficient of thermal expansion of the substrate material 20. If, for example, copper or steel is used as substrate material 20, it is preferred when selecting the metals for the metallic material 40 to use a metal mixture or a metal alloy whose coefficient of thermal expansion corresponds as well as possible to that of the substrate material.

In order to arrange that the electron absorber layer 30 ensures electron absorption which is as high as possible, the material inclusions 60, that is to say, for example, (B—, C—, SiC—) dispersants, are incorporated with a high percentage fraction into the electron absorber layer 30 in order to reduce the average atomic number of the resulting electron absorber layer 30. The function of the metallic material 40 is then reduced in graphically descriptive terms merely to an adhesive property in order to fasten the material inclusions 60 permanently on the substrate 10, even if stresses form at the layer boundary between the electron absorber layer 30 and the substrate material 20 owing to fluctuations in the temperature of the substrate, and thus to expansion or shrinkage of the surface 50.

Although modifications and changes may be suggested by those skilled in the art, it is the intention of the inventor to embody within the patent warranted hereon all changes and modifications as reasonably and properly come within the scope of his contribution to the art.

We claim:

1. A method for applying an electron absorber layer to a substrate, comprising the steps of:

providing a substrate;

producing an electron absorber layer as a composite material by coating the substrate with a metallic material and embedding material inclusions, comprised of an additional material other than said metallic material, in said metallic material during coating of said substrate with said metallic material; and selecting an amount and composition of said metallic material and said material inclusions that simultaneously gives said electron absorber layer electron absorption properties and thermal expansion properties that substantially match thermal expansion properties of said substrate.

2. A method as claimed in claim 1 comprising formulating said additional material to comprise a substance selected from the group consisting of boron, carbon, silicon, a mixture having at least two of boron or carbon or silicon, a chemical compound formed by at least two of boron or carbon or silicon, and a mixture of respective chemical compounds each being formed of at least two of boron or carbon or silicon.

3. A method as claimed in claim 2 comprising formulating said additional material to contain at least 50% of said substance by volume.

4. A method as claimed in claim 1 comprising formulating said additional material to contain a substance selected from the group consisting of elemental boron, elemental carbon, elemental silicon and a mixture of at least two of elemental boron or elemental carbon or elemental silicon.

5. A method as claimed in claim 4 comprising formulating said additional material to contain at least 50% of said substance by volume.

6. A method as claimed in claim 1 comprising formulating said additional material to contain a substance selected from the group consisting of boron carbide, silicon carbide, and a mixture of boron carbide and silicon carbide.

7. A method as claimed in claim 6 comprising formulating said additional material to contain at least 50% of said substance by volume.

8. A method as claimed in claim 1 comprising embedding said material inclusions to comprise at least 50% of said electron absorber layer by volume.

9. A method as claimed in claim 1 comprising applying said electron absorber layer on said substrate by cold gas spraying.

10. A method as claimed in claim 1 comprising selecting said metallic material from the group consisting of aluminum, magnesium, a mixture of aluminum and magnesium, and an alloy of aluminum and magnesium.

11. A method as claimed in claim 1 comprising selecting said metallic material from the group consisting of cobalt, iron, chromium, an alloy of at least two of cobalt or iron or chromium, and a mixture of at least two of cobalt or iron or chromium.

12. A method as claimed in claim 1 comprising selecting said metallic material from the group consisting of titanium, nickel, copper, an alloy of at least two of titanium or nickel or copper, and a mixture of at least two of titanium or nickel or copper.

13. A method as claimed in claim 1 comprising applying said metallic material to said substrate as a conductive metallic matrix, and embedding said material inclusions in the conductive metallic matrix.

14. A method as claimed in claim 1 comprising selecting said additional material forming said material inclusions as being material having an atomic number of less than 14.

15. A method as claimed in claim 1 wherein said substrate has a coefficient of thermal expansion, and comprising selecting said metallic material to give said electron absorber layer a coefficient of thermal expansion that substantially matches said coefficient of thermal expansion of said substrate, and selecting said additional material forming said material inclusions as material having an atomic number of less than 14.

16. A method for applying an electron absorber layer to a substrate, comprising the steps of:

providing a substrate exhibiting a coefficient of thermal expansion;

producing an electron absorber layer as a composite material by coating the substrate with a metallic material and embedding material inclusions, comprised of an additional material other than said metallic material, in said metallic material during coating of said substrate with said metallic material; and selecting said metallic material to give said electron absorber layer a coefficient of thermal expansion that substantially matches said coefficient of thermal expansion of said substrate.

17. A method for applying an electron absorber layer to a substrate, comprising the steps of:

providing a substrate;

producing an electron absorber layer as a composite material by coating the substrate with a metallic material and embedding material inclusions, comprised of an additional material other than said metallic material, in said metallic material during coating of said substrate with said metallic material; and selecting said additional material that forms said material inclusions as material having an atomic number of less than 14.

* * * * *